US006311368B1

(12) United States Patent
Sartori

(10) Patent No.: US 6,311,368 B1
(45) Date of Patent: Nov. 6, 2001

(54) HANDLE FOR HOUSEHOLD UTENSILS

(75) Inventor: Francesco Sartori, Bologna (IT)

(73) Assignee: Carl Freudenberg, Weinheim (DE)

( * ) Notice: Subject to any disclaimer, the term of this patent is extended or adjusted under 35 U.S.C. 154(b) by 0 days.

(21) Appl. No.: 09/355,536

(22) PCT Filed: Aug. 8, 1997

(86) PCT No.: PCT/EP97/04320

§ 371 Date: Oct. 12, 1999

§ 102(e) Date: Oct. 12, 1999

(87) PCT Pub. No.: WO99/07523

PCT Pub. Date: Feb. 18, 1999

(51) Int. Cl.[7] ..... B25G 1/04

(52) U.S. Cl. ..... 16/429; 16/427; 15/144.3; 15/144.4

(58) Field of Search ..... 16/429, 427, 405, 16/113.1; 15/144.3, 144.4

(56) References Cited

U.S. PATENT DOCUMENTS

| | | | | |
|---|---|---|---|---|
| 4,653,142 | * | 3/1987 | Upton | 16/113.1 |
| 5,228,202 | * | 7/1993 | Liao | 15/144.4 |
| 5,387,048 | * | 2/1995 | Kuo | 15/144.4 |
| 5,515,574 | | 5/1996 | Larson . | |
| 5,533,768 | | 7/1996 | Mitchell . | |

FOREIGN PATENT DOCUMENTS

| | | |
|---|---|---|
| 272533 | 12/1950 | (CH) . |
| 3625287 | 2/1988 | (DE) . |
| 19617365 | 11/1996 | (DE) . |

* cited by examiner

*Primary Examiner*—Anthony Knight
*Assistant Examiner*—Enoch Peavey
(74) *Attorney, Agent, or Firm*—Fulbright & Jaworski, LLP

(57) ABSTRACT

Disclosed is a handle for household utensils, in particular for floor cleaning utensils, the external polygonal contour of which presents side faces (6) and edges (7).

14 Claims, 5 Drawing Sheets

A–A

B–B

HANDLE FOR HOUSEHOLD UTENSILS

FIELD

The invention relates to a handle for household implements, in particular floor care implements, in the operation of which a rotary motion must also be transmitted by way of the handle.

PRIOR ART

The mop handles heretofore employed by Applicant comprise a round outer contour, corresponding to the turned wooden handles or round handles of metal or plastic for brooms, scrubbers or the like.

These handles have the disadvantage that when a rotary motion, either isolated or superimposed on a wiping motion, is transmitted, the user effects the transmission solely by a firm grip around the handle, thus producing a friction link. A rotary motion is required for example in order to press a mop into contact with a sieve suspended over the pail.

Especially in use of household implements designed for wet application, after wringing, out by hand the film of moisture greatly reduces the friction, so that an additional exertion of force is required to produce the rotary motion.

Furthermore, there is the danger of blistering of the user's hands when rotating the handle by friction, since different skin layers may be displaced relative to each other.

The object of the invention is to create a handle for household implements that avoids these disadvantages.

EXPOSITION OF THE INVENTION

With a polygonal outer contour, consisting of faces and edges, the user's hand can get a purchase on the faces, and bring about a sort of geometrical hold on the edges. The required grip for the frictional hold can be reduced, thus countering the blistering hazard. The handle may consist of wood, plastic, metal or other material.

Advantageously, the outer contour comprises two to four faces and a corresponding number of edges. An outer contour having three faces and three edges has proved especially favorable, since here a compromise is achieved between a good grip and a good transmission of force. The decisive point here is the angle included between two neighboring faces; it should be as obtuse as possible for a good bjp, and as acute as possible for good transmission. With three faces, the included angle is about 60°; with four faces, about 90°.

To reduce weight, the handle is hollow, its inner contour matching its outer contour. Preferably metal or plastic is used as material.

So that the length of the handle may be varied, the handle comprises several releasably interconnected segments of like outer contour, with coupling elements arranged in the hollow interior. The coupling elements partly project beyond the segment in order to engage the next following segment. This multipartite construction has advantages also in transport of the handle, namely a much shorter length than the assembled handle. Owing to the polygonal inner contour of the segments, the coupling element engaged by the polygonal contour is geometrically secured against rotation, so that no additional security measures, for example bonding, are required to transmit the torque. The catch means provided in the coupling element for axial fixation of the segments in relation to each other are not loaded rotationally but only axially.

In a modification, the handle consists of a guide tube and a telescoping rod guided therein, the telescoping rod having an outer contour of smaller size matching the guide tube in shape and being fixed in various positions in the guide tube by means of a catch device. With telescoping handles, a variable change of handle length is possible. Compared to known telescoping handles, the advantage consists in that the catch device need assume only axial forces, since the rotary motion is transmitted geometrically. For known handles, where the telescoping rod is locked by tightening on a taper, there is danger that the user operating the household implement may not note the direction of rotation of the rotary motion, thus releasing the taper.

Another modification consists in that the end of the handle near the user is provided with a fixable cap guided axially displaceable with respect to the end of the handle and held in at least two positions. This enables the length of the handle to be changed. Here again, use is made of geometrical fixation to transmit the rotary motion, by way of improving the rotary loadability of a cap disclosed in DE GM 94 107 91. The catch device is here likewise stressed lengthwise only.

Owing to the polygonal outer contour of the handle, additional friction elements to enhance friction, for example rubber rings, may be dispensed with.

BRIEF DESCRIPTION OF THE DRAWING

The invention will be represented in terms of a telescoping handle as well as a handle assemblable from several segments as shown in the drawing, where.

EMBODIMENT OF THE INVENTION

Figure 1:
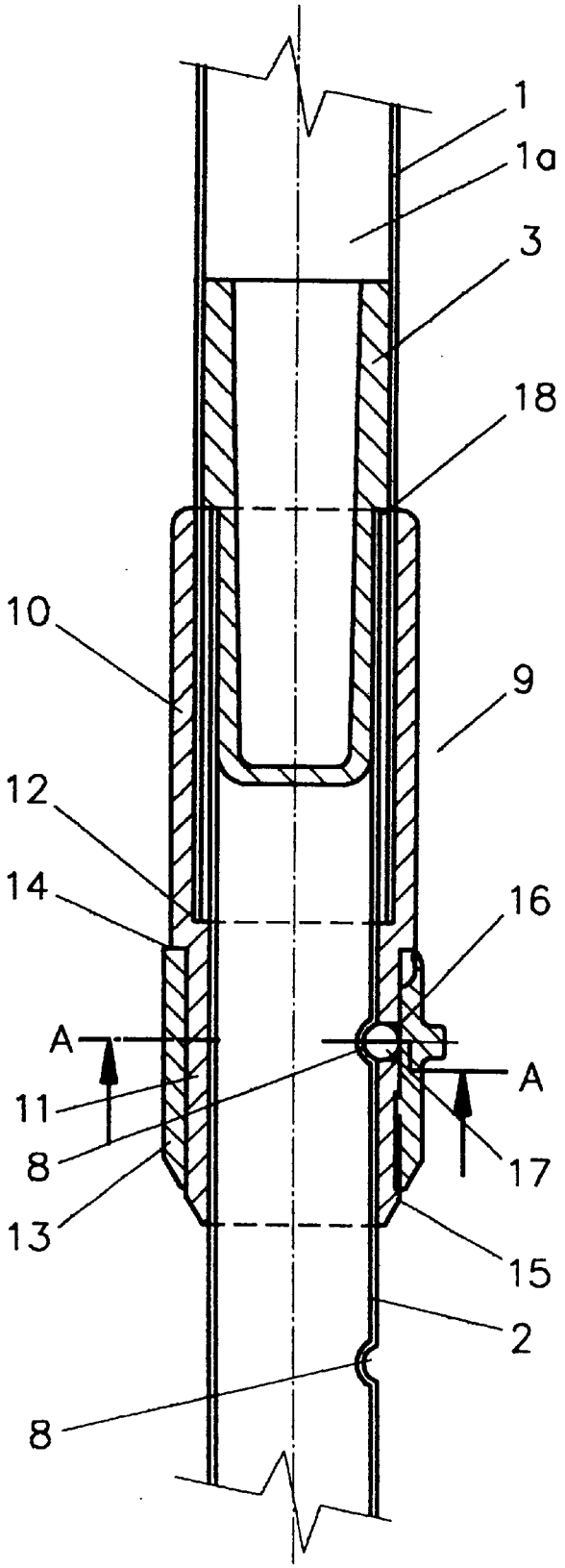
FIG. 1 shows a telescoping handle with fixation device locked.

In FIG. 1, a telescoping handle of metal is represented, comprising a guide tube 1 and a telescoping tube 2. The telescoping tube 2 projects into a cavity 1*a* of the guide tube 1 and is guided therein by means of a guide part 3. The guide part 3 is fixed in turn in the hollow telescoping tube 2.

Figure 2:
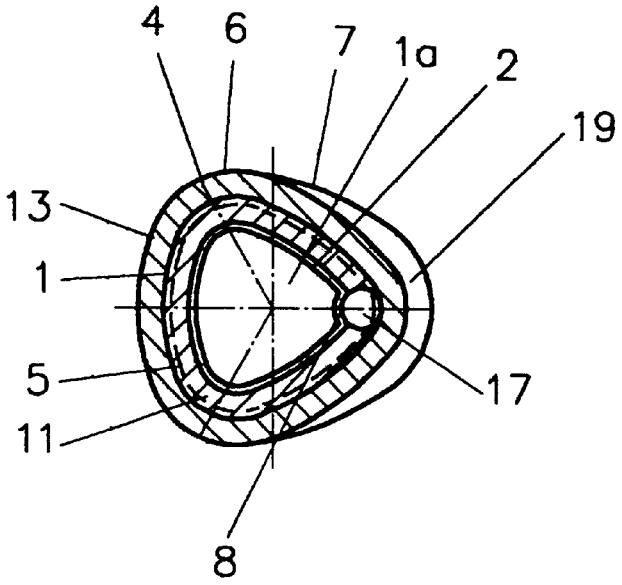
FIG. 2 shows a section at the line A—A in FIG. 1.

Both the outer contour 4 and the inner contour 5 of the guide tube 1 and of the telescoping tube 2 have the configuration of a polygon having three somewhat concavely curved faces and three very concavely curved edges 7 (FIG. 2).

The telescoping tube 2 is provided at one end 7 with indentations 8 arranged at regular intervals. It is immaterial just where the indentations 8 are located. The indentations 8 cooperate with a fixation device 9 represented in FIG. 1.

The fixation device 9 is placed on the end of the guide tube 1 accommodating the telescoping tube 2, and comprises a first segment 10 snugly enclosing the guide tube, The segment 10 is connected to the guide tube 1 by friction. The segment 10 is adjoined by the second segment 11, comprising a reduced inside dimension compared to the first segment 10, so that a shoulder 12 is formed between the first and second segments 10, 11. The first segment 10 of the fixation device 9 is thrust onto the guide tube 1 far enough so that it is seated on the shoulder 12. Owing to the frictional connection, which may in principle be made alternatively by bonding or otherwise the axial location of the fixation device is thereby fixed.

The second segment 11 of the fixation device 9 comprises an inner contour matching the outer contour 4 of the telescoping tube 2, the telescoping tube 2 being guided with clearance. Extending around the second segment 11, there is a sleeve 13, axially displaceable along the second segment 11 between two stops 14, 15.

Further, the second segment 11 is provided with an opening 16 to accommodate a ball 17. The diameter of the ball 17 is so chosen that the ball engages the indentation 8 of the telescoping tube 2 and is prevented by the sleeve 13 from slipping out of the opening 16.

The telescoping rod 2 is guided firstly in the segment 11 and secondly by the guide part 3, which is inserted in 1 tte end thrust into the guide tube 1 and retained by friction. Against unintentional withdrawal of the telescoping rod 2 from the guide tube 1, the guide part 3 is provided with a shoulder 18 cooperating with the stop 12. The shoulder 18 is formed by the difference in dimension of the inner contour 5 of the guide tube 1 from the outer contour 4 of the telescoping tube 2.

The section shown in FIG. 2 details the polygonal outer and inner contours of the handle, reflected in the telescoping tube 2, the second segment 11 of the fixation device 9, and the sleeve 13. The inner contour 5 of the guide tube 1 is shown dotted. The ball 17 rests in an indentation 8 of the telescoping tube 2 and in the opening 16 in the second segment 11. For a better grip of the sleeve 13, a projection 19 is provided extending at least partly beyond the periphery of the sleeve 13 and exhibiting its greatest distance from the sleeve 13 in the neighborhood of the ball 17.

Figure 3:
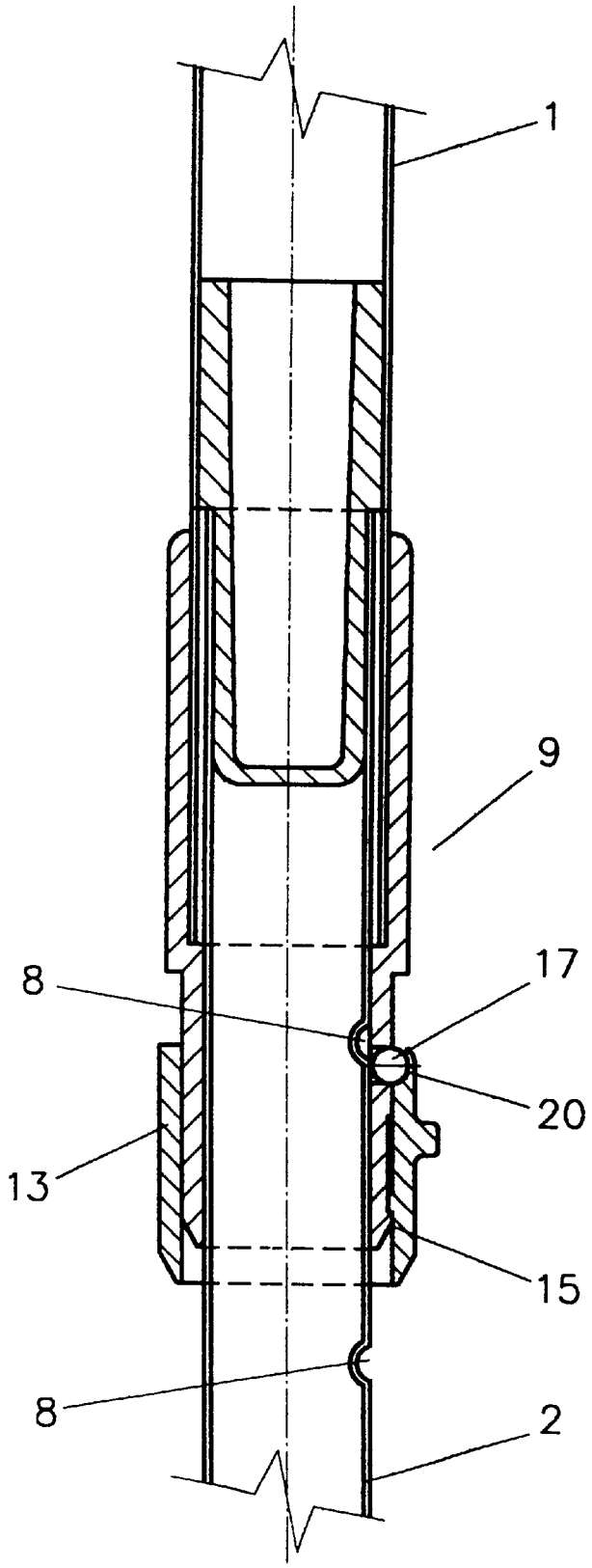
FIG. 3 shows the telescoping handle with fixation device unlocked.

FIG. 3 shows the fixation device 9 in an opened condition, i.e. the fixation is released and the telescoping tube 2 can be displaced in the guide tube 1. For this purpose, the sleeve 13 has been axially displaced away from the guide tube 1 up to the stop 15, enabling the ball 17 to exit the indentation 8. For this purpose, the sleeve 13 comprises a portion 20 accommodating the ball 17, and keeping it from dropping out. Here, the portion 20 exerts a spring action on the ball 17, so that the latter, upon displacement of the telescoping rod 2, slips into the indentation 8, thus enabling the user to readily recognize the several positions of fixation.

Figure 4:
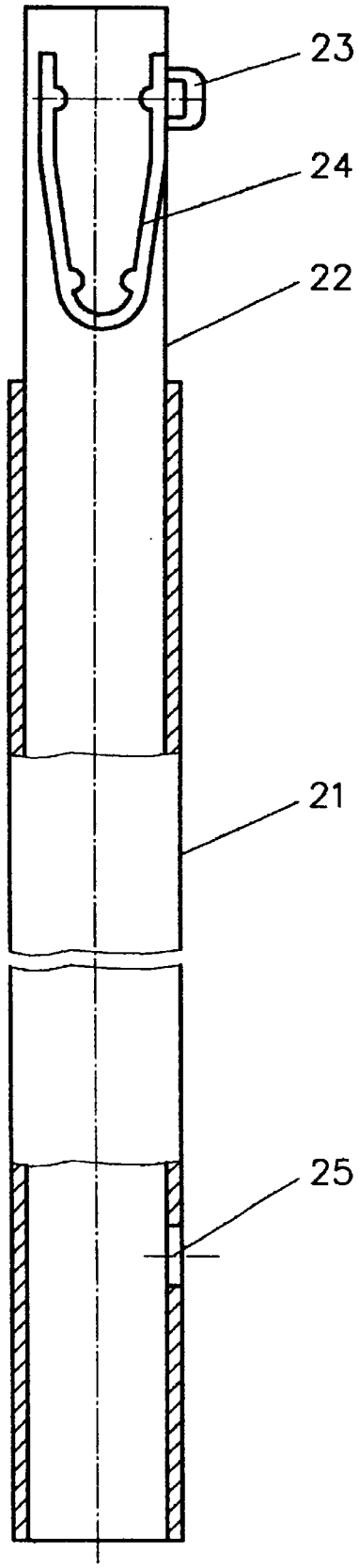
FIG. 4 shows a handle segment of a handle assemblable from several handle segments.

FIG. 4 shows a handle segment 21 of metal, of a handle consisting of several handle segments. The handle segment 21, at one end, comprises a coupling element 22 of plastic. This coupling element 22 is thrust into the handle segment 21 and is permanently connected thereto, for example by bonding. A portion of the hollow coupling part 22 protruding from the handle segment is provided with a knob 23 capable of being pressed into the coupling part 22 against a spring 24. At the other end of the handle segment, the latter is provided with an opening 24 matching the knob 23, the opening 24 being at such a distance from the end of the handle segment 21 that the protruding portion of the coupling piece 22 can be accommodated with the knob 23, and the knob 23 can engage the opening 24.

By joining several handle segments 21 together, a handle may be assembled in various lengths.

Figure 5:
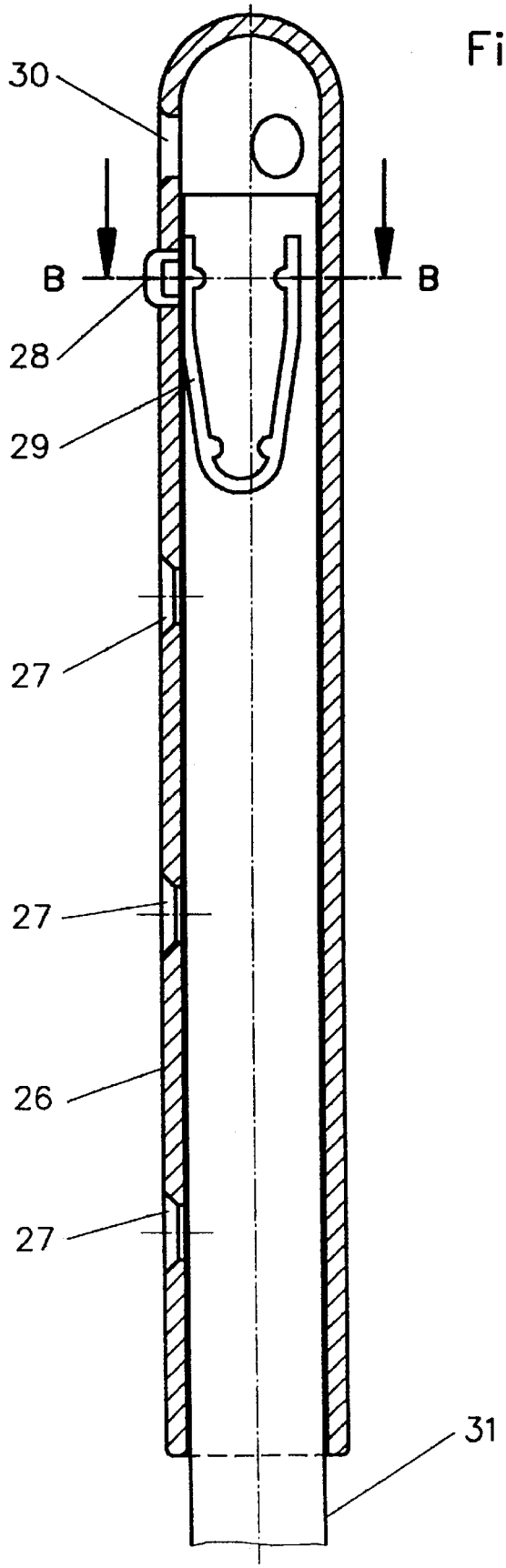
FIG. 5 shows a cap to be placed on the end of the handle.

FIG. 5 shows a handle cap 26 of plastic to be placed on the end 31 of a handle near the user. The handle cap 26 is placed lengthwise displaceably on the end 31 of the handle and lockable in various positions preassigned by openings 27 by means of a fixation device consisting of knob 28 and spring 29. The locking device 28, 29 is accommodated in the end 31 of the handle, the end 31 of the handle comprising an opening through which the knob protrudes. The inner contour of the handle cap 26 matches the outer contour of the end 31 of the handle and is therefore polygonal. The linkage of the handle cap 26 with the end 31 is established geometrically upon rotation of the handle cap 27. The handle cap 26 is provided with additional openings 30 by means of which the handle end 31 may for example be hung in a hook.

Figure 6:
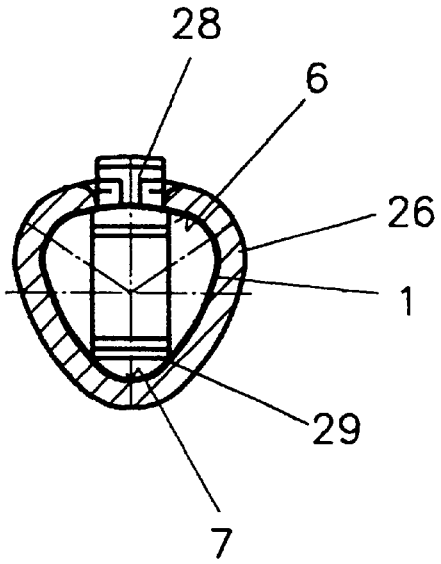
FIG. 6 shows a section of the end of the handle with cap in place, along the line B—B of FIG. 5.

FIG. 6 shows the location of the spring 29 in the end 31 of the handle with fixed handle cap 26. The knob 28 is consequently in disengaged position. The spring 29 bears firstly on the inside wall in the neighborhood of the sharply curved edge 7 of the end 31 of the handle, and secondly on the face 6. Through an opening in the face 6 and in the handle cap 26, the knob 28 projects some distance out.

What is claimed is:

1. A telescoping handle for household implements comprising:

an outer contour which is polygonal and comprises faces and edges;

a ball;

a guide tube having a telescoping tube guided therein, said telescoping tube having at least one indentation on an edge to accommodate said ball, said telescoping tube having an outer contour of smaller size and matching the guide tube in shape;

a fixation device positioned at an end of the guide tube and comprising a first segment for guiding said telescoping tube and a second segment having an opening therein to accommodate said ball, said fixation device adapted to fix said telescoping tube in various positions in the guide tube; and a sleeve being axially displaced along said second segment of said fixation device and comprising a portion accommodating said ball, said sleeve being arranged around said second segment of said fixation device to prevent said ball from slipping out of said opening; wherein said ball has a diameter such that said ball engages said indentation of said telescoping tube.

2. The telescoping handle of claim 1, wherein said portion accommodating said ball exerts an inward spring action on said ball by pressuring said ball towards said telescoping rod such that upon displacement of said telescoping rod the ball slips into said indentation.

3. The handle of claim 2, wherein said outer contour comprises two to four faces and a corresponding number of edges.

4. The handle of claim 3, wherein the handle is hollow, the inner contour of the handle matching its outer contour.

5. The handle of claim 2, wherein said outer contour comprises three faces and a corresponding number of edges.

6. The handle of claim 5, wherein the handle is hollow, the inner contour of the handle matching its outer contour.

7. The handle of claim 2, wherein the handle is hollow, the inner contour of the handle matching its outer contour.

8. The handle of claim 1, wherein said outer contour comprises two to four faces and a corresponding number of edges.

9. The handle of claim 8, wherein said faces concavely curved and connected to each other by concavely curved edges.

10. The handle of claim 9, wherein the handle is hollow, the inner contour of the handle matching its outer contour.

11. The handle of claim 8, wherein the handle is hollow, the inner contour of the handle matching its outer contour.

12. The handle of claim 1, wherein said outer contour comprises three faces and a corresponding number of edges.

13. The handle of claim 12, wherein the handle is hollow, the inner contour of the handle matching its outer contour.

14. The handle of claim 1, wherein the handle is hollow, the inner contour of the handle matching its outer contour.

* * * * *